US011584577B2

(12) United States Patent
Alayon Rivera et al.

(10) Patent No.: US 11,584,577 B2
(45) Date of Patent: Feb. 21, 2023

(54) CONTACT LENS PACKAGE KIT WITH RECYCLING FASTENER

(71) Applicant: CooperVision International Limited, Fareham (GB)

(72) Inventors: Javier E. Alayon Rivera, Juana Diaz, PR (US); Cataldo Zucaro, Rochester, NY (US); Brittany Whitenack, Rochester, NY (US); Lucas Sievens Figueroa, San Juan, PR (US); Jesus Javier Rivera Velez, Juana Diaz, PR (US)

(73) Assignee: COOPERVISION INTERNATIONAL LIMITED, Fareham (GB)

( * ) Notice: Subject to any disclaimer, the term of this patent is extended or adjusted under 35 U.S.C. 154(b) by 0 days.

(21) Appl. No.: 17/534,475

(22) Filed: Nov. 24, 2021

(65) Prior Publication Data

US 2022/0185565 A1 Jun. 16, 2022

Related U.S. Application Data

(60) Provisional application No. 63/124,106, filed on Dec. 11, 2020.

(51) Int. Cl.
*B65D 75/36* (2006.01)
*B65D 75/56* (2006.01)

(52) U.S. Cl.
CPC ..... *B65D 75/366* (2013.01); *B65D 75/56* (2013.01); *B65D 2575/361* (2013.01); *B65D 2585/545* (2013.01)

(58) Field of Classification Search
CPC ..... B65D 75/366; B65D 75/56; B65D 2575/361; B65D 2585/545
(Continued)

(56) References Cited

U.S. PATENT DOCUMENTS 2,429,581 A 10/1947 Maitlen
2,730,294 A 1/1956 Stavis et al.
(Continued)

FOREIGN PATENT DOCUMENTS

CN 203237581 U 10/2013
JP 2002302179 A 10/2002
(Continued)

OTHER PUBLICATIONS

International Search Report and Written Opinion issued in corresponding International Patent Application No. PCT/GB2021/053220 dated Feb. 2, 2022 (17 pages).
(Continued)

*Primary Examiner* — Jacob K Ackun
(74) *Attorney, Agent, or Firm* — Kilyk & Bowersox, P.L.L.C.

(57) ABSTRACT

A contact lens package kit is described that includes a contact lens packages, wherein each contact lens package includes a base member having a cavity and a sealing member coupled to the base member. An unworn contact lens is provided in a packaging solution within the sealed cavity. The base member is a thermoplastic material (or other recyclable material) and includes a substantially planar surface surrounding the cavity to provide a sealing surface for the sealing member. The kit also includes at least one fastener configured to retain a plurality of base members from each of the contact lens packages after the contact lens is removed from the cavity. A recyclable thermoplastic contact lens assembly is also described, that includes empty contact lens packages attached to a fastener. A method to recycle used contact lens packages, such as curbside recycling, is further described that uses the fastener, and the fastener itself is also described.

19 Claims, 5 Drawing Sheets

(58) Field of Classification Search
USPC ..... 206/5.1, 493, 347
See application file for complete search history.

(56) References Cited

U.S. PATENT DOCUMENTS

| | | | | |
|---|---|---|---|---|
| 3,307,693 | A | 3/1967 | Bittner | |
| 3,938,587 | A | 2/1976 | Vian | |
| 4,215,797 | A * | 8/1980 | Chen | B65D 43/022 220/276 |
| 4,233,878 | A | 11/1980 | McGauran et al. | |
| 4,582,194 | A | 4/1986 | Karpiloff et al. | |
| 4,669,635 | A | 6/1987 | Brookhart | |
| 4,930,829 | A * | 6/1990 | Paulson | B65D 67/02 206/427 |
| 5,080,398 | A | 1/1992 | Groswith, III | |
| 5,236,749 | A * | 8/1993 | Ewing | B65D 75/36 428/137 |
| 5,486,390 | A * | 1/1996 | Burns | B32B 27/36 206/532 |
| 5,499,723 | A | 3/1996 | Morrow | |
| 5,993,755 | A * | 11/1999 | Andersen | G02C 13/008 422/292 |
| 6,253,912 | B1 * | 7/2001 | O'Neill | B65D 75/327 53/396 |
| RE37,558 | E * | 2/2002 | Abrams | B65D 75/327 206/820 |
| 6,474,465 | B1 * | 11/2002 | Jux | B65D 75/326 206/820 |
| 6,775,873 | B2 | 8/2004 | Luoma | |
| 7,426,993 | B2 * | 9/2008 | Coldrey | B65D 75/366 206/5.1 |
| 7,477,366 | B2 | 1/2009 | Clements et al. | |
| 8,025,314 | B2 * | 9/2011 | Adler | A61J 7/04 40/310 |
| 9,659,509 | B2 * | 5/2017 | Luea | G09F 3/206 |
| 10,072,405 | B2 | 9/2018 | Beck et al. | |
| 10,455,952 | B2 | 10/2019 | Smith | |
| 10,631,665 | B2 | 4/2020 | Loucks | |
| 11,097,319 | B2 * | 8/2021 | Kolb | A61M 15/0085 |
| 2006/0054514 | A1 | 3/2006 | Tokarski et al. | |
| 2006/0127638 | A1 | 6/2006 | Harsley | |
| 2007/0051653 | A1 * | 3/2007 | Tilton | B65D 75/22 206/461 |
| 2008/0006540 | A1 | 1/2008 | Newman et al. | |
| 2009/0038977 | A1 * | 2/2009 | Tilton | B65D 73/0057 53/485 |
| 2011/0162171 | A1 | 7/2011 | Gmeilbauer | |
| 2011/0289884 | A1 * | 12/2011 | Guschke | B65D 77/003 53/411 |
| 2014/0284229 | A1 * | 9/2014 | Newman | A45C 11/046 206/213.1 |
| 2014/0331602 | A1 | 11/2014 | Newman | |
| 2015/0252832 | A1 | 9/2015 | Le Grange | |
| 2016/0249720 | A1 * | 9/2016 | Esguerra | B65D 23/12 206/5.1 |
| 2018/0037388 | A1 * | 2/2018 | Vinet | B65D 77/204 |
| 2018/0170638 | A1 | 6/2018 | Patton | |
| 2019/0009977 | A1 * | 1/2019 | Huang | B65B 25/008 |
| 2019/0039798 | A1 * | 2/2019 | Davis | B65D 75/326 |
| 2019/0078606 | A1 | 3/2019 | Shehab | |
| 2019/0168937 | A1 | 6/2019 | McDowell, III | |
| 2019/0293961 | A1 * | 9/2019 | Schweizer | G02C 7/04 |
| 2019/0388607 | A1 * | 12/2019 | Pontecorvo | A61M 3/0262 |
| 2021/0000267 | A1 | 1/2021 | Hubbard | |
| 2021/0122507 | A1 * | 4/2021 | Lingle | B65B 27/086 |
| 2022/0031033 | A1 * | 2/2022 | Grischenko | C08K 5/34924 |

FOREIGN PATENT DOCUMENTS

| | | | |
|---|---|---|---|
| JP | 4965225 | B2 | 7/2012 |
| KR | 20100010426 | A | 2/2010 |
| TW | 201321279 | A | 6/2013 |
| WO | 0105280 | A1 | 1/2001 |
| WO | 2020152446 | A1 | 7/2020 |

OTHER PUBLICATIONS

Search and Exam Report issued in corresponding United Kingdom Patent Application No. GB2117774.6 dated Apr. 8, 2022 (7 pages).
Office Action and Search Report issued in corresponding Taiwan Patent Application No. 110145578 dated Aug. 18, 2022 (with English translation) (18 pages).
International Preliminary Report on Patentability issued in corresponding International Patent Application No. PCT/GB2021/053220 dated Nov. 18, 2022 (47 pages).

* cited by examiner

CONTACT LENS PACKAGE KIT WITH RECYCLING FASTENER

This application claims the benefit under 35 U.S.C. § 119(e) of prior U.S. Provisional Patent Application No. 63/124,106, filed Dec. 11, 2020, which is incorporated in its entirety by reference herein.

FIELD

The present invention relates to contact lens packaging and the recycling of at least parts of the packaging. More particularly, the present invention relates to kits and methods to recycle at least a plurality of base members, once used.

BACKGROUND

Newly manufactured contact lenses are frequently packaged in contact lens blister packages or blister packs. For example, a newly manufactured contact lens will be placed in a cavity or bowl of a plastic base member of a contact lens blister package, a contact lens packaging solution will be provided in the blister package cavity, and a foil sealing member will be adhered to the blister package to hermetically seal the contact lens in the packaging solution in the cavity. In other words, a contact lens blister package used in the manufacture of contact lenses contains a base member having a cavity, an unworn contact lens provided in a packaging solution within the cavity, and a sealing member sealed to the base member to provide an air tight seal around the perimeter of the cavity.

The base members of the blister packages are generally formed of a thermoplastic or plastic material and it is common for a user to peel away the sealing member, take the unworn contact lens out, and discard the empty blister package in the trash that is not recycled. Each individual blister package is too small to be recycled as plastic at a recycling center because most recycling processes of plastic require minimum dimensions and if these dimensions are not met, most recycling lines have steps to remove these smaller objects and not recycle them. In other words, the objects like individual blister packages are not recycled and instead are treated as non-recyclable trash or waste. The material that the contact lens package is made of is a recyclable material and so there is a need to address this problem so that contact lens packaging can be recycled in the same manner as plastic bottles and the like.

Thus, it can be appreciated that there remains an important environmental need to improve contact lens packaging, which, among other things, provides the ability to actually recycle the contact lens package or portion thereof, once used.

SUMMARY

A feature of the present invention is to provide a contact lens wearer with the ability to successfully have the contact lens package (or portion thereof) accepted as recyclable material at a recycling facility or MERF (Material Recovery Facility).

An additional feature of the present invention is to provide a method for the contact lens wearer or purchaser to easily recycle contact lens packages or portions thereof (e.g., via curbside recycling).

A further feature of the present invention is to provide a contact lens wearer or purchaser a simple way to recycle opened or used contact lens packages (e.g. by curbside recycling).

Also, a feature of the present invention is to provide a way to recycle used or opened contact lens packages as a collective unit such that the packages that form the collective unit preferably do not break or separate while being processed at a recycling facility.

Additional features and advantages of the present invention will be set forth in part in the description that follows, and in part will be apparent from the description, or may be learned by practice of the present invention. The objectives and other advantages of the present invention will be realized and attained by means of the elements and combinations particularly pointed out in the description and appended claims.

To achieve these and other advantages, and in accordance with the purposes of the present invention, as embodied and broadly described herein, the present invention, in part, relates to a contact lens package kit. The kit includes at least a plurality of contact lens packages, wherein each contact lens package includes a base member having a cavity and a sealing member coupled to the base member to provide a sealed cavity, and an unworn contact lens is provided in a contact lens packaging solution within the sealed cavity. The base member is a thermoplastic material (or recyclable material) and includes a substantially planar surface surrounding the cavity. The substantially planar surface provides a sealing surface for the sealing member. The kit also includes at least one fastener configured to retain a plurality of base members from each of the contact lens packages after the contact lens is removed from the cavity.

The present invention further relates to a recyclable thermoplastic contact lens assembly. The assembly includes a plurality of empty contact lens packages, wherein each empty contact lens package includes a base member having a cavity and wherein the base member is a thermoplastic material (or other recyclable material) and has a substantially planar surface surrounding the cavity. The assembly also includes at least one fastener, wherein the plurality of base members is attached to the fastener.

The present invention also relates to a method to recycle used contact lens packages. The method enables used contact lens packages to become sorted for recycling at recycling facilities or MERFs. The method includes the step or steps of attaching a plurality of empty contact lens packages (or portions thereof) to a fastener. Each empty contact lens package includes at least a base member having a cavity. The base member is a thermoplastic material (or other recyclable material) and has a substantially planar surface surrounding the cavity.

In addition, the present invention relates to a fastener for attaching a plurality of empty contact lens packages (or portions thereof) to the fastener. Each empty contact lens package includes at least a base member having a cavity. The base member is a thermoplastic material (or other recyclable material) and has a substantially planar surface surrounding the cavity.

It is to be understood that both the foregoing general description and the following detailed description are exemplary and explanatory only and are intended to provide a further explanation of the present invention, as claimed.

The accompanying drawings (not to scale), which are incorporated in and constitute a part of this application, illustrate some of the features of the present invention and together with the description, serve to explain the principles of the present invention.

DETAILED DESCRIPTION

Figure 1:
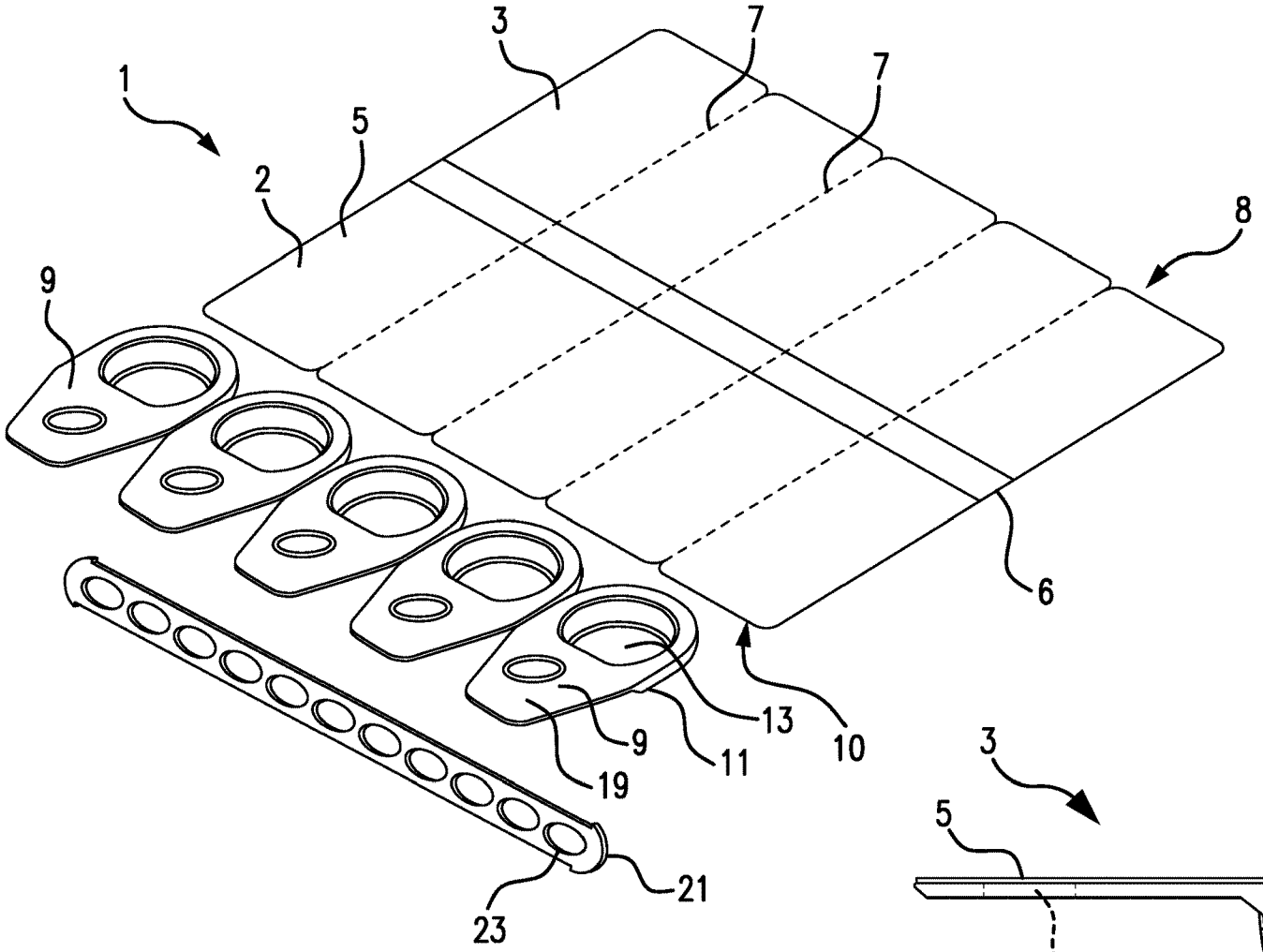
FIG. 1 is a front prospective view of an example of contact lens package kit with an array of contact lens packages with a fastener. For easier understanding, FIG. 1 further shows one array of base members (with the sealing members removed) that are present below the sealing members shown.

The present invention relates to a contact lens package kit as well as to a method to recycle used contact lens packages. The present invention further relates to a contact lens package assembly that is a collection of used contact lens packages that are all held by or attached to at least one fastener. The present invention also relates to the fastener itself and its ability to receive and hold the used contact lens packages so that the fastener with attached used contact lens packages are suitable as a recyclable material (for instance, with respect to dimensions required or requested for recycling of material).

The present invention enables used contact lens packages to become sorted (i.e. can be processed) for recycling at recycling facilities or MERFs. In other words, the present invention provides the ability, to the user, to recycle the used or opened contact lens packages (e.g., blister packages) or portions thereof and provides the ability to take a plurality of the opened or used contact lens packages (e.g., blister packages) to form a recyclable unit that has dimensions and an assembly that can withstand handling through sorting facilities. Thus, with the present invention, recycling, such as curbside recycling, is possible and feasible and easy to accomplish by the contact lens wearer or purchaser.

The present invention provides a contact lens wearer or purchaser a simple way to recycle opened or used contact lens packages (e.g. by curbside recycling) which can encourage use of the present invention.

In more detail, with respect to the contact lens package kit, this kit comprises, consists essentially of, consist of, includes or is a plurality of contact lens packages (e.g., new or unused contact lens packages) and at least one fastener.

The plurality of contact lens packages can be more than one, two or more, three or more, four or more, five or more, ten or more, twenty or more, thirty or more, sixty or more, or 90 or more. There is no limit to the number of contact lens packages in the kit.

Each contact lens package comprises, consists essentially of, consists of, or includes a base member having a cavity and a sealing member coupled to the base member to provide a sealed cavity. An unworn contact lens is provided in the sealed cavity, and optionally in a contact lens packaging solution also within the sealed cavity.

With respect to the contact lens package, this package can include or comprise a plastic base member comprising a cavity configured to retain the contact lens and packaging solution and a flange region extending outwardly around the cavity. The sealing member (or sealing lid) can be a removable foil or can be a cover or a lid (e.g., plastic lid or plastic member) that is attached to the planar or flange region to provide a sealed contact lens package. Such contact lens packages, which are commonly referred to as "blister packs", are well-known in the art (see e.g. U.S. Pat. No. 7,426,993).

If the sealing member is plastic as well, then the sealing member can optionally be recycled along with the plastic base member in the present invention.

The base member comprises, consists essentially of, consists of or is a thermoplastic material or recyclable plastic or other recyclable material (e.g., plastic, PVC, polypropylene). The base member generally is made of a material that is recyclable, meaning the material can be taken to a recycle facility or trash facility and put in a recycle bin, such as the plastics recycle bin. The base member can be made of conventional material used for contact lens base members. In one preferred embodiment, the base member is formed from a polypropylene resin.

The base member has or includes a substantially planar surface (or flange region) surrounding the cavity. The substantially planar surface provides a sealing surface for the sealing member. With the sealing member on the planar surface, a sealed cavity is formed. The term "substantially planar" means a planar surface or a surface surrounding the cavity that is at least 80% in surface area, or at least 90% in surface area, or at least 95% in surface area, or at least 99%, or 100% in surface area planar or flat. The sealing member is sealed to the base member to create a seal that can withstand autoclaving conditions used to sterilize the unworn contact lenses. Once the seal is broken by separating the sealing member from the base member, the contents of the contact lens package (e.g. blister package) are no longer sterile.

With respect to the fastener, each fastener is configured or shaped or designed to retain a plurality of the base members from each of the contact lens packages after the contact lens is removed from the cavity (e.g., a used and empty base member). In the kit, at least one fastener is provided (e.g., one or two or more fasteners). The fastener(s) can be loosely provided in the kit or can be removably attached to one or more of the contact lens packages or can be removably attached to the box (e.g., an inner surface of the box) that contains the contact lens packages or can be removably attached to informational material or papers that may be included in the contact lens package kit.

The plurality of contact lens packages can be arranged in an array and have perforations in the sealing member at a location corresponding to adjacent base members. This permits the easy removal of individual contact lens packages for use.

The base members can include an opening that is spaced apart from the cavity. The opening is dimensioned to receive the fastener and thus attach the base member to the fastener. With the opening, the base member slides onto the fastener to create an attachment that prevents the easy removal of the base member from the fastener.

The opening on the base member can have any opening geometry. For instance, the opening can have an oval shape, a circular shape, an elliptical shape, a rectangle shape, a square shape, a triangle shape, or other design. The fastener, described in more detail below, has a corresponding shape so that the base member can attach to the fastener through the opening on the base member. This can be considered a through-hole design.

The fastener has a length, width, and thickness. The fastener can be made from at least one thermoplastic or plastic or other recyclable material. As an option, the fastener can be made from the same material as the base member (e.g., same thermoplastic material). As an option, the fastener is made from a material that is the same recycling category as the base members (e.g., plastics).

As an option, the fastener itself can have a weight that is less than 2 grams (e.g., from 0.2 g to 1.99 g, from 0.2 g to 1.95 g, from 0.2 g to 1.3 g, from 0.4 g to 1.9 g, from 0.4 g to 1.5 g, from 0.4 g to 1.25 g, from 0.3 g to 1 g).

As an option, the fastener can have a total weight that is less than 10% of the total weight of the plurality of the base members retained by the fastener.

As an option, the fastener can have a weight that is no greater than the total weight of the material needed to occupy the openings of each of the plurality of the base members provided in a kit, when the base members have this design.

As an option, the fastener can have a length, such that at least 5 or at least 7 or at least 10 or at least 20 or at least 30 of the empty base members are attachable to the fastener. For instance, from 7 to 90 or from 10 to 90 empty base members can be attached to the fastener. In one preferred embodiment, the fastener is dimensioned (e.g., the fastener has a length suitable) to retain 14 empty base members. In another preferred embodiment, the fastener is dimensioned (e.g., the fastener has a length) suitable to retain 28 empty base members.

In one aspect, the kit contains a plurality of fasteners so that a person can discard the base packages attached to the fastener on a regular schedule that, for instance, corresponds to a recycle material pick-up schedule (if one exists). For example, if a person has recycled plastics picked up for recycling once per week, and the person has thirty used or open contact lens packages (e.g. blister packs) in the kit, the kit can include four fasteners so that seven used or open contact lens packages (e.g. blister packs) from the kit can be attached to the fastener and that used fastener can then be placed in a recycled bin for that weekly pick-up, and there are enough fasteners for each weekly pick up for the kit of thirty used or open contact lens packages (e.g. blister packs). Or, two fasteners can be provided in kits of thirty lenses, and each fastener can hold fourteen used or open contact lens packages (e.g. blister packs), and can be discarded weekly or biweekly on the recycling schedule.

As an option, the fastener can have a plurality of openings. The openings can be located along a majority of the length of the fastener (e.g., along 55% or more, 60% or more, 70% or more, 80% or 90% or more of the length). The openings can be equally spaced from each other. The openings can be of the same size or different sizes with respect to the other openings. The shape of the opening(s) can be any geometrical shape, such as a circle, triangle, or rectangle. In addition to or in lieu of one or more or all of the openings, symbols, logos, or words can form the openings on the fastener. For instance, the company name "CooperVision" can be located on the fastener as shown, for instance, in FIG. 6. The purpose of these types of openings is to reduce the amount of material used to form the fastener.

The fastener can have openings along the length that serve a different purpose. As an option, the fastener can have a plurality of openings, wherein each of the openings is shaped so as to receive at least a portion of the base member thereby attaching the base member to the fastener. The opening is dimensioned to receive at least an edge or side portion of the base member and thus attach the base member to the fastener. With this type of opening on the fastener, the base member can be inserted into an opening of the fastener to create an attachment that prevents the easy removal of the base member from the fastener.

As an example, the openings on the fastener can be provided, such as in the shape of slits or slots, where the slits or slots can be equally spaced from each other. The fastener can have one or more columns of slits or slots to house/receive the empty base members. Further, an edge of a base member (for example, a base member having a thumb grip) can be slid or inserted into the slit or slot to retain or attach the empty base member to the fastener. As an option, the thumb grip side of the base member, if present in the design, can have protruding features, and these protruding features can be utilized to hold/lock the base member in place. The slot or slit can have a height that is the same or about the same as the thickness of the surface of the base member (e.g., thickness of the planar surface or thickness of the thumb grip side) (e.g., within 5%, or within 1% of that thickness).

To create an attachment that is not easily removed, as an option, the openings or slits or slots in the fastener can be dimensioned so that one or more edges of the base member (e.g., the thumb grip side) forms a pressure fit or interference fit or snug fit with the opening, slit, or slot on the fastener.

Regarding the overall shape of the fastener, any shape can be used, and the length, width, and thickness is not critical. For environmental reasons, a preference is to have the fastener as thin as possible so as to conserve on the amount of material used to form the fastener. The fastener can be molded or stamped or 3D printed into shape. The material used to form the fastener can be virgin material (e.g., plastic resin pellets), recycled material, or can be the scrap material, such as material obtained during base member molding or manufacturing. Generally, the length is such that the fastener can conveniently fit into the overall contact lens packaging. The length of the fastener can also dictate the number of empty base members that can be attached to the fastener. The dimensions of the fastener also can take into account minimizing the amount of material used to make the fastener.

As one example, the fastener can be an elongated flat profiled strip.

The fastener can have an elongated profile with a cross-section that has a circular shape, polygonal shape, T-shape, U-shape, or edges with a hollow interior. There are no limits to the shape of the fastener.

As an option, the base members are attachable to the fastener such that the plurality of empty base members are oriented on the fastener in either in a singled stacked configuration or an alternating multiple stacked configuration. The empty base members can optionally be rested on top of each other when attached to the fastener. The empty base members can optionally not touch a base member immediately below and/or above that base member.

In a design of the fastener, as an option, the fastener has a length, a width, a top end, a bottom end, and side edges, and wherein the side edges (e.g. both side edges) include indentations or notches along a majority of the length (e.g., along 60% or more, 70% or more, 80% or more, 90% or more of the length). The indentations or notches can be shaped to interlock (e.g., removably interlock or click or hold) with the edges/sides of the opening in each of the base members, when the base members have this design.

As an example, the fastener can have a length of from 50 mm to 100 mm (e.g. from 60 mm to 100 mm, from 70 mm to 100 mm, from 80 mm to 100 mm, from 60 mm to 90 mm, from 60 mm to 85 mm, from 70 mm to 85 mm). The width of the fastener can be from 5 mm to 20 mm (e.g. from 5 mm to 15 mm, from 5 mm to 10 mm, from 7 mm to 15 mm, from 8 mm to 12 mm). The thickness of the fastener can be 0.25 mm to 2 mm (e.g., from 0.25 mm to 1.75 mm, from 0.25 mm to 1.5 mm, from 0.25 to 1 mm, from 0.25 to 0.75 mm, from 0.25 mm to 0.5 mm, from 0.3 mm to 2 mm, from 0.4 mm to 2 mm, from 0.5 mm to 2 mm, from 0.7 mm to 2 mm, from 0.8 mm to 2 mm, from 0.9 mm to 2 mm from 1 mm to 2 mm). As a more specific example, the fastener can have an overall length of 81 mm, an overall width of 10 mm, and a thickness of 1 mm (or dimensions within 20%, or within 10%, or within 5% or within 1% of any one, two, or all three of these dimensions).

Figure 5:
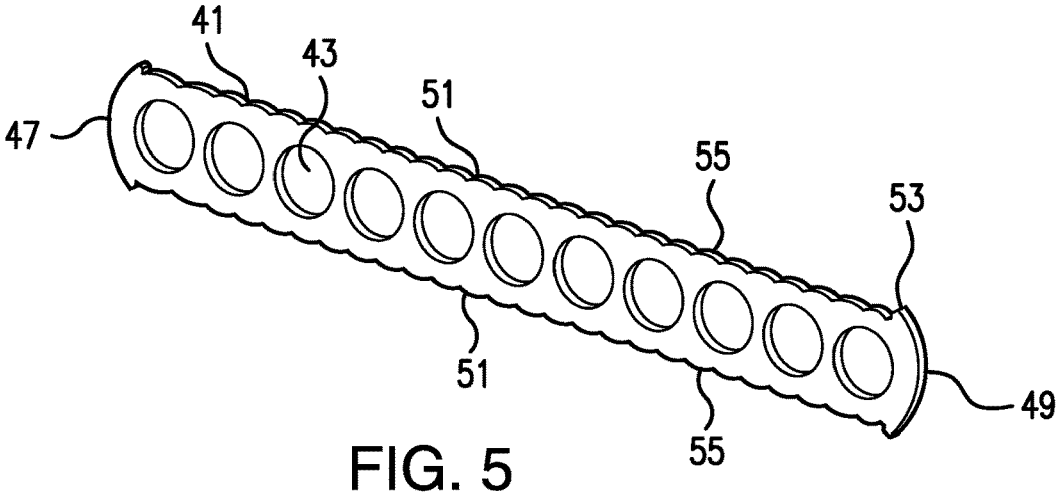
FIG. 5 is a front view of an example of a fastener of the present invention.
Figure 6:
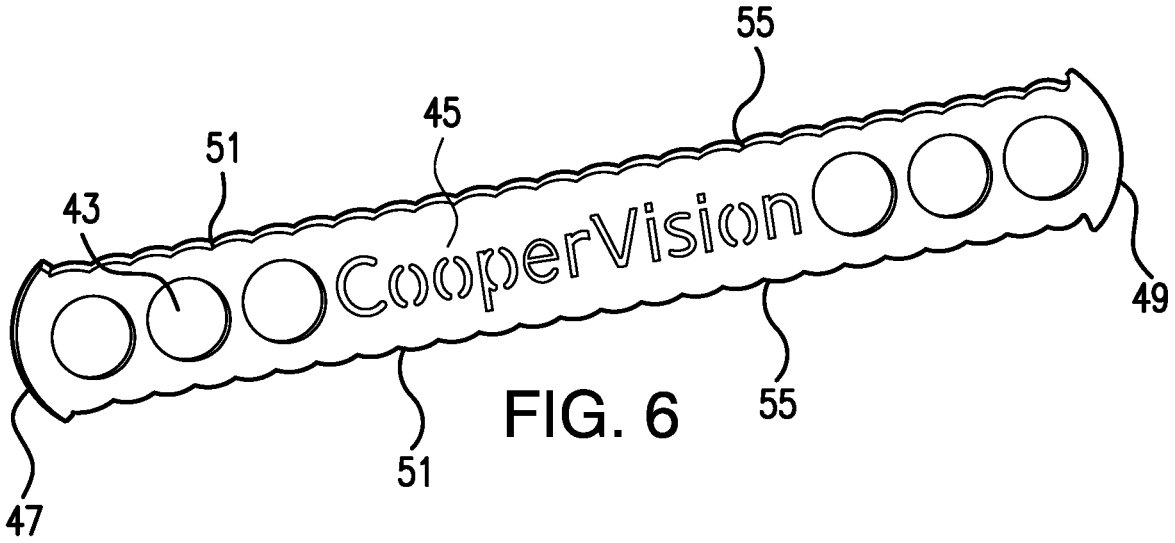
FIG. 6 is a front view of a further example of a fastener of the present invention.
Figure 7:
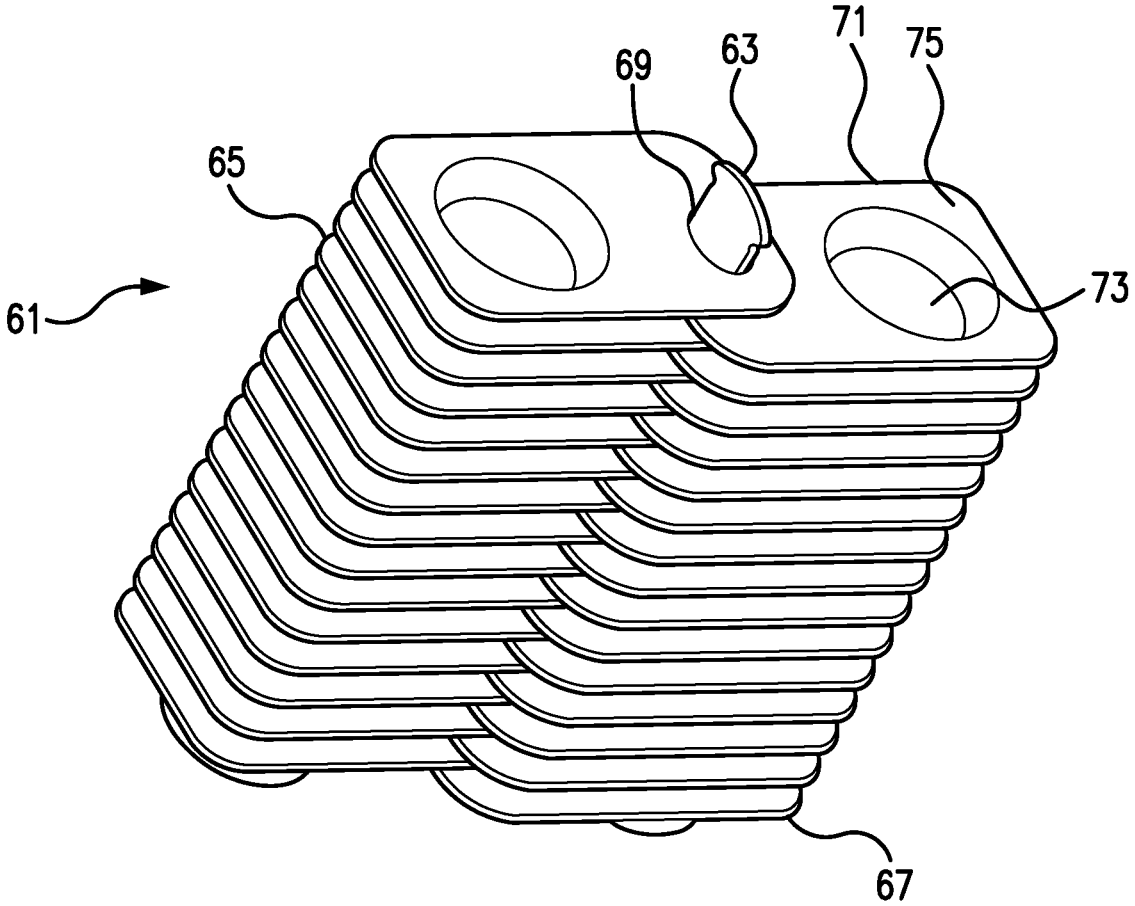
FIG. 7 is a top-front view of a fastener with attached empty base members of the present invention.

The fastener can have indentations or notches distributed evenly along most of the length of the side edges. Also, the indentations or notches are located along each of the side edges such that the indentation or notches are across from each other (i.e., the indentations or notches on side edge mirror the indentations or notches on the other side edge, so as to form a pair of indentations or notches, for instance as shown in FIG. 5 and FIG. 6). Each pair of indentations or notches can come into contact with a portion of the edge of an opening of a base member such that the base member can rest or remain at that respective indentation or notch. The number of indentations or notches can generally equal the number of base members intended to be attached to the fastener. For instance, a fastener made to hold 30 base members can have 30 indentations or notches on each side edge of the fastener. FIG. 7 shows an example of the base members attached to the fastener and engaging the plurality of indentations or notches. The indentations or notches can have any shape, such as a half circle or half triangle or half rectangle and the like. The depth or cut of the indentation or notch can be any amount. For instance, the indentation or notch can have a maximum depth of 0.05 mm, or 0.07 mm, or 0.1 mm or 0.125 mm, or 0.15 mm, or 0.175 mm, or 0.2 mm, or 0.225 mm or 0.25 mm, or 0.3 mm and the like. The indentation or notch may or may not have a uniform depth.

The fastener has a top edge and bottom edge. The shape of the top edge can be the same or different from the shape of the bottom edge. The fastener can have at least one of a top edge or bottom edge that has a larger width than the rest of the fastener. The top edge and/or bottom edge can have a width that is at least 5% (e.g., at least 10%, at least 15%, at least 20%, at least 25%, or at least 30%) larger than the width of the rest of the fastener. The larger width top edge and/or bottom edge provides the ability to retain a base member more securely once the base member is attached to the fastener. This design is more relevant when the through-hole design is used in the base member.

The width of the top edge and/or bottom edge can be the same as or within 5% of the diameter of the opening on the base member (e.g., within 4% of the diameter, within 3% of the diameter, within 2% of the diameter, within 1% of the diameter). The width of the top edge and/or bottom edge can be slightly larger than the diameter of the opening on the base member. The width of the fastener located between the top edge and bottom edge can be the same or about the same than the diameter or cross-section of the opening on the base member (for the through-hole design). The width of the top edge and/or bottom edge is such that the opening of the base member can be put through the fastener with a slight force and thus the base member is securely attached to the fastener and cannot be removed easily (e.g. the base member will not slide off due to gravity or due to gripping of the fastener with the base members attached). Thus, preferably, the fastener has at least a bottom end (or bottom edge) that is shaped such that the opening of the base member cannot pass through (e.g., cannot pass through unless the fastener and/or opening of the base member is stretched or distorted to some degree). As an example, the slight force can be characterized as at least an amount of force that a person can move the base member onto the fastener, but that the base member cannot fall off or be removed from the fastener without a greater amount of force than used to apply or attach the base member to the fastener in the first instance.

As another example, the design of the fastener can be such that a portion of the base member is slid into an opening (e.g., slit or slot). In this example, the attaching of the base members to the fastener is by way of inserting an edge (e.g., the thumb grip side of the base member through a respective slit or slot (or opening) located on the fastener. The openings on the fastener (e.g. slot) are dimensioned such that an edge or side of the base member (e.g. thumb grip side) is slid or pushed through or pulled through the slot partially until a snug fit or a sort of interference fit is obtained. As an example, a side of the base member, such as the thumb grip side can have an increasing width in the direction toward the cavity of the base member and the opening (e.g., slot) can be dimensioned to have a width (the size of the opening) that is less than the maximum width of the base member (e.g., less than the maximum width present on the thumb grip side). For instance, from 1% to 99% or from 10% to 90% or approximately half of the length of the thumb grip side can be inserted into the opening (e.g., slot) before interference occurs and a snug fit is obtained.

The kit of the present invention may also comprise a carton, box, or container or other packaging (herein at times referred to as 'carton'). The carton can be made from virgin or recycled cardboard, lid stock, compressed paper, and the like. Thus, in this embodiment, a kit of the present invention comprises, consists essentially of, or consists of, a carton, a plurality of sealed contact lens packages (e.g. blister packs) containing sterilized unworn contact lenses, and at least one fastener. In a further embodiment, such a kit comprises a plurality of fasteners (i.e., two or more fasteners). In yet a further embodiment, such a kit comprises thirty contact lens packages (e.g. blister packs), sixty contact lens packages (e.g., blister packs), or ninety contact lens packages (e.g., blister packs). The carton may also be understood to be a box or container or package or enclosure.

Figure 2:
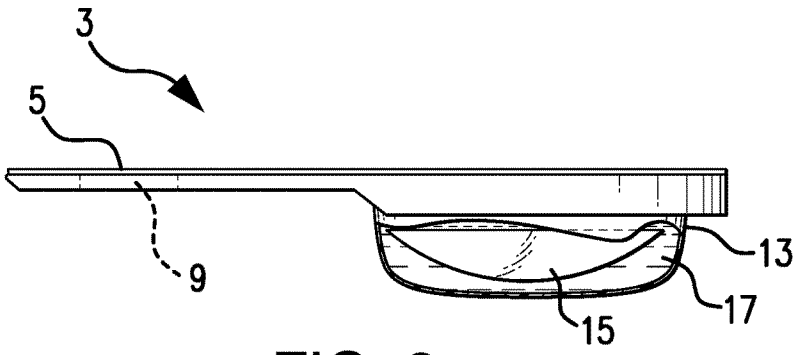
FIG. 2 is a side view of one of the contact lens packages shown in FIG. 1.

FIGS. 1 and 2 show an example of a contact lens package kit (1) that includes a plurality of contact lens packages as an array (2) and at least one fastener (21). The individual contact lens packages (3) are connected together to form the array (2) and perforation lines (7) are used for easy removal of each individual contact lens package (3). Each contact lens package (3) has a sealing member (5) that forms a seal over the cavity (13) of the base member (11). An unworn contact lens (15) and packaging solution (17) are within the cavity (13). The kit (1) further includes at least one fastener (21) which has openings (23) (optional). For the contact lens package (3), in this example, each contact lens package (3) has an opening (9) on the base member (11) that is spaced apart from the cavity (13) and dimensioned so as to receive the width and thickness of the fastener (21). A substantially planar surface (19) is shown for receiving the sealing member (5) for each respective base member (11). An array of base members is shown separated from the sealing members for ease of viewing. FIG. 2 is a side view of one of the contact lens packages (3) shown in FIG. 1.

As an option, the material shown as (6) in FIG. 1 can be shaped/designed to be the fastener which can be removed and then used as a fastener as described herein.

As an option, the side (8) and/or side (10) as shown in FIG. 1 can have the fastener attached such as in a perforated attachment design that can be torn off or removed and then used as a fastener.

Figure 3:
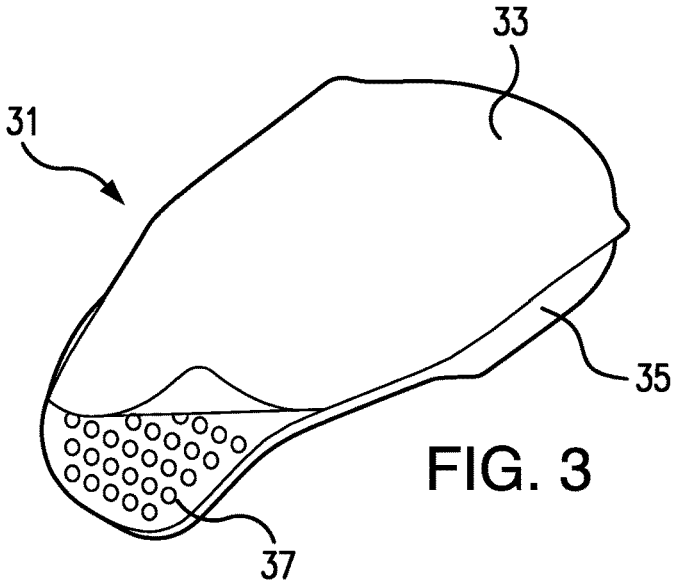
FIG. 3 is a front prospective view of a further example of a contact lens package with a thumb grip.
Figure 4:
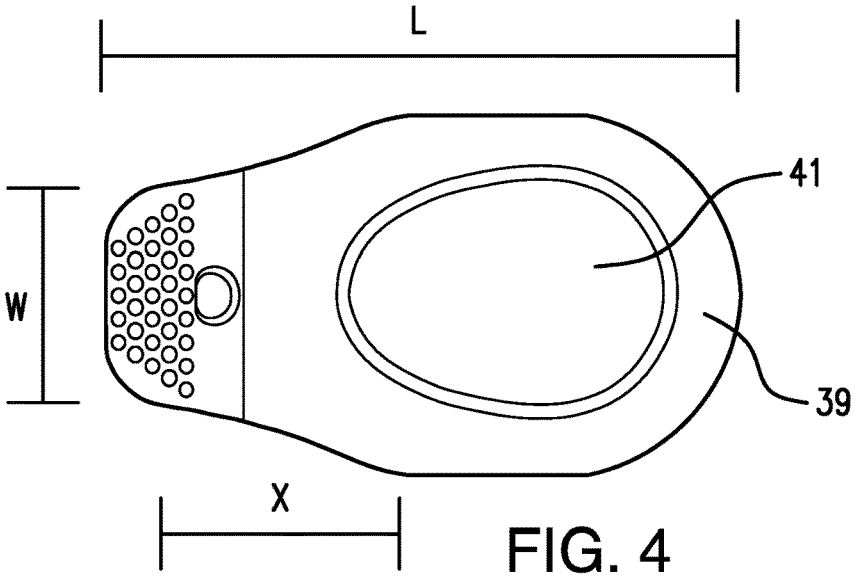
FIG. 4 is a top view of the contact lens package of FIG. 3.

FIG. 3 and FIG. 4 show a further example of a contact lens package (31) with a thumb grip design (37). The contact lens package (31) has a sealing member (33) that seals the cavity (41) using the sealing surface (39) that is substantially planar. Zone X shows the location where a pressure fit or snug fit will occur when slid or inserted into a slit or slot of a fastener. "L" represents the overall length of the contact lens package (31) and "W" is the width of the thumb grip side.

FIG. 5 and FIG. 6 provide examples of a fastener (41). FIG. 5 has a fastener (41) with the optional openings (43) and FIG. 6 shows a fastener (41) with optional openings (43) and an optional logo/company name (45). These openings and logo/company name (43), (45) reduce the amount of material needed to form the fastener (41). The fastener (41) has notches or indentations (51) along the length of the fastener and present on each side edge (55) of the fastener (41). Each fastener (41) has a rounded top and bottom edge (47) and (49) where the width is larger at these edges than the rest of the fastener as can be seen in FIGS. 5 and 6.

FIG. 7 shows an example of a recyclable thermoplastic (or plastic or other recyclable material) contact lens assembly (61). A plurality of empty contact lens packages (65) is stacked in alternating multiple stacked configuration (67). Each empty contact lens package (65) has a base member (71) having a cavity (73) and the base member (71) has a substantially planar surface surrounding the cavity (75). The contact lens assembly (61) further includes at least one fastener (63) and the plurality of base members (71) are attached to the fastener (63). In this example, the attaching of the base members (71) to the fastener (63) is by way of openings (69) located on each of the base members (71) where the opening (69) is spaced apart from the cavity (73).

Figure 8:
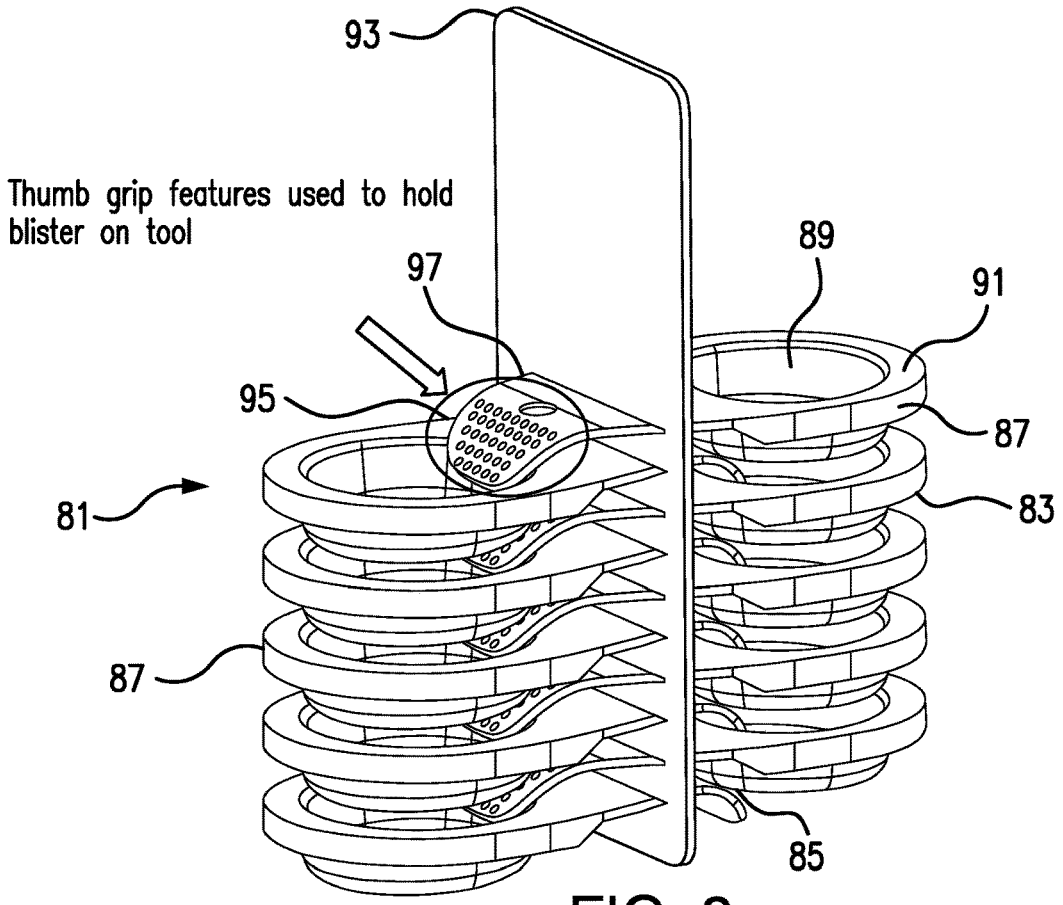
FIG. 8 is a front view of a further example of a fastener with attached empty base members of the present invention.
Figure 9:
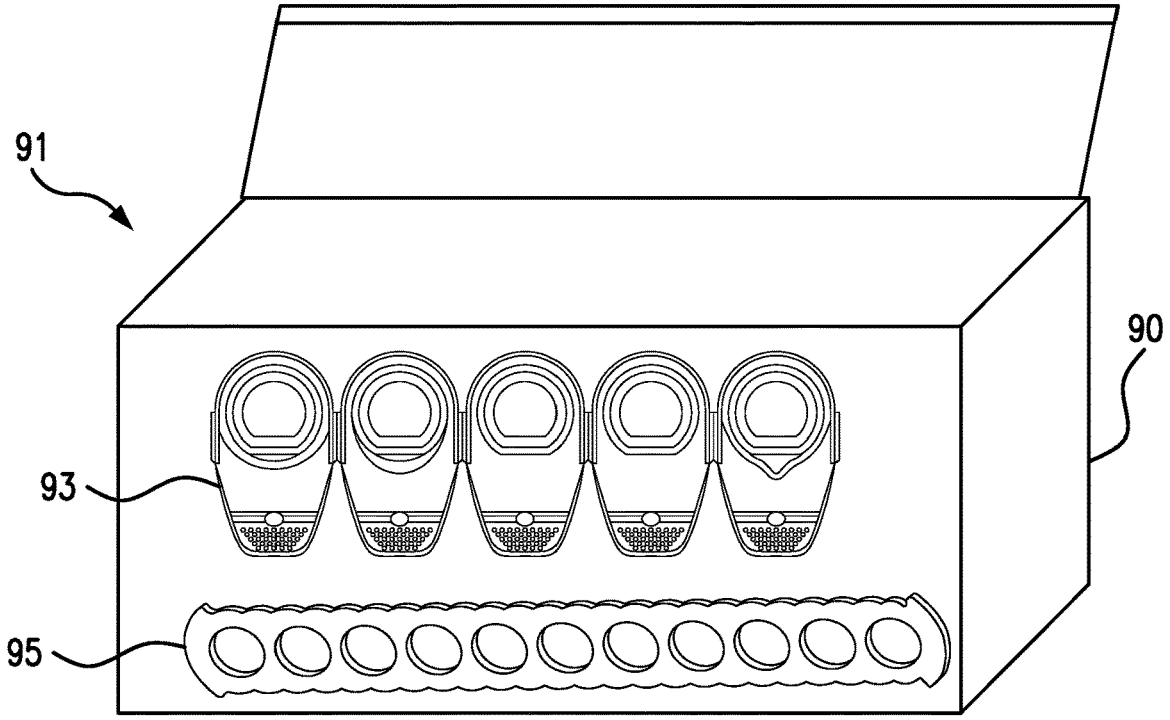
FIG. 9 is a front prospective view of an opened kit or carton that contains one example of an array of contact lens packages and at least one fastener.

FIG. 8 is a further example of a recyclable thermoplastic (or plastic or other recyclable material) contact lens assembly (81). A plurality of empty contact lens packages (83) is optionally stacked in alternating multiple stacked configuration (85). Each empty contact lens package (83) has a base member (87) having a cavity (89) and the base member (87) has a substantially planar surface surrounding the cavity (91). The contact lens assembly (81) further includes at least one fastener (93) and the plurality of base members (87) are attached to the fastener (93). In this example, the attaching of the base members (87) to the fastener (93) is by way of inserting the thumb grip side (95) of the base member (87) through respective slot (or openings) (97) located on the fastener (93). The slot (97) is dimensioned such that the thumb grip side (95) of the base member (87) is slid or pushed through the slot until a snug fit or a sort of interference fit is obtained. In this example, the thumb grip side has an increasing width in the direction towards the cavity (89) of the base member (87) and the slot (97) is dimensioned to a width (opening) that is less than the maximum width of the base member (87) present on the thumb grip side. As shown in FIG. 8, approximately half of the length of the thumb grip side (95) is inserted into the slot (97) before interference occurs and a snug fit is obtained. The increasing width along the thumb grip towards the cavity can be seen in FIG. 4, indicated by zone X.

Figure 10:
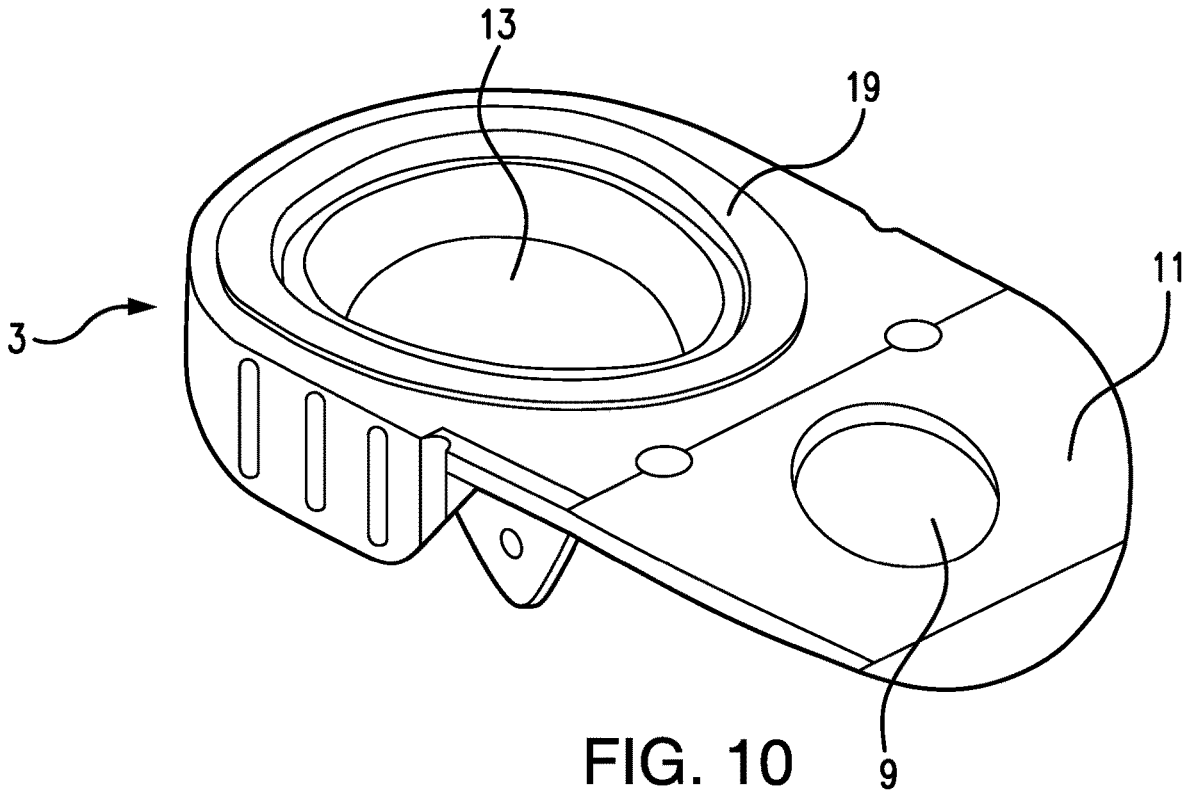
FIG. 10 is a further example of a contact lens package with an opening in the base member for use with a fastener.

FIG. 10 is a further example of a contact lens package (3) (with the sealing member not shown). The contact lens package, as in FIG. 1, has a cavity (13), a substantially planar surface (19), and has an opening (9) for receiving a fastener. In FIG. 10, a thumb type design (11) is shown.

The present invention further includes a recyclable thermoplastic contact lens assembly. The assembly can be considered a recyclable plastic contact lens assembly. In lieu of a thermoplastic material, any recyclable material can be used. The assembly includes a plurality of empty contact lens packages as described herein. Each empty contact lens package comprises a base member having a cavity. The base member is as described herein, and the base member is a thermoplastic material (or other recyclable material) and has a substantially planar surface surrounding the cavity. The assembly further includes at least one fastener, as described herein, and the plurality of base members are attached to the fastener, as described herein (e.g. the base members have openings spaced apart from the cavity and dimensioned to receive the fastener for attaching or the thumb grip side of the base member is used to attach the base member to the fastener that has receiving slots/openings.) The base members attached to the fastener are empty (i.e., the sealing member has been opened or removed and the contact lens removed by the wearer or user.) If the sealing member is of the same recycle category as the base member, as an option, the sealing member can be attached as well to the fastener by one of the same techniques used to attach the base member to the fastener as described herein (e.g., through hole design or inserting an edge).

As an option, the recyclable thermoplastic assembly can have at least an overall height of at least 2 inches (e.g., from 2 inches to 6 inches or more) and either or both of a width and depth of at least 2 inches (e.g., from 2 inches to 6 inches or more). These dimensions permit the assembly to be deposited into a recycling bin and be acceptable for recycling in a recycling facility.

The present invention further includes a method to recycle used contact lens packages, such as the ones described herein. The method comprises, consist essentially of, consists of, or includes the step of attaching a plurality of empty contact lens packages (as described herein) to a fastener(s) (as described herein). As indicated, each empty contact lens package comprises a base member having a cavity and the base member is a thermoplastic material (or other recyclable material) and has a substantially planar surface surrounding the cavity. The attaching can be achieved a number of ways as described herein (e.g. the base members have openings spaced apart from the cavity and dimensioned to receive the fastener for attaching or the thumb grip side or another side of the base member is used to attach the base member to the fastener that has receiving slots/openings.)

The present invention also relates to the fastener itself, as described herein.

As indicated, the unworn contact lens is sealed within the cavity of the sealed contact lens package and is packaged in a contact lens packaging solution. Any contact lens can be packaged therein. For example, the contact lens can be a hydrogel contact lens or it can be a silicone hydrogel contact lens. Examples of contact lenses that can be provided in the packages include those having the following United States Adopted Names (USANs): methafilcon A, ocufilcon A, ocufilcon B, ocufilcon C, ocufilcon D, omafilcon A, omafilcon B, comfilcon A, enfilcon A, stenfilcon A, fanfilcon A, etafilcon A, senofilcon A, senofilcon B, senofilcon C, narafilcon A, narafilcon B, balafilcon A, samfilcon A, lotrafilcon A, lotrafilcon B, somofilcon A, riofilcon A, delefilcon A, kalifilcon A, and the like. The contact lens packaging solution is typically a buffered saline solution, such as a phosphate buffered saline solution or a borate buffered saline solution, that may contain one or more additives, such as surfactants, wetting agents, viscosity agents, and the like.

The contact lens in the base member can be a soft contact lens, such as a soft silicone hydrogel contact lens.

The contact lens may be of any lens wear modality. Lens wear modality refers to the how many days and nights in a row the lens can be worn without removal. In one example, the contact lens is a daily disposable lens. Daily disposable lenses are indicated for single use, up to about 12 or 16 hours of continuous wear and should be discarded after the single use. In another example, the contact lens is a daily wear lens. Daily wear lenses are worn during the waking hours, typically up to about 12 to 16 hours, and are removed before sleep. Daily wear lenses are typically stored in a contact lens case containing a contact lens care solution for cleaning and disinfecting the lens during the hours of non-use. Daily wear lenses are typically discarded after a maximum of 30 days wear. In yet another example, the contact lens is an extended wear lens. Extended wear lenses are typically worn continuously for up to 6, 14 or 30 consecutive days and nights.

The packaging solution sealed within the contact lens package may be any conventional contact-lens compatible solution. In one example, the packaging solution comprises, consists, or consists essentially, of an aqueous solution of a buffer, and/or a tonicity agent. In another example, the packaging solution contains additional agents such as one or more additional antimicrobial agents, and/or a comfort agent, and/or a hydrophilic polymer, and/or a surfactant and/or other beneficial agent. In some examples, the packaging solution may comprise polysaccharides (e.g. hyaluronic acid, hydroxypropyl methylcellulose, hydroxypropyl cellulose, hydroxyethyl cellulose, etc.) or other high molecular weight polymers, such as polyvinyl pyrrolidone, which are commonly used as comfort polymers or thickening agents in ophthalmic solutions and contact lens packaging solutions. In other examples, the packaging solution may comprise an ophthalmic drug. The packaging solution can have a pH in the range of about 6.8 or 7.0 up to about 7.8 or 8.0. In one example, the packaging solution comprises phosphate buffer or borate buffer. In another example, the packaging solution comprises a tonicity agent selected from sodium chloride or sorbitol in an amount to maintain osmolality in the range of about 200 to 400 mOsm/kg, and typically from about 270 mOsm/kg up to about 310 mOsm/kg.

It will be appreciated that conventional manufacturing methods can be used to manufacture the sealed contact lens package. In a method of manufacturing a contact lens package, the method can include the step of placing an unworn contact lens and a contact lens packaging solution in a receptacle, placing a cover on the receptacle, and sealing the cover on the receptacle. Generally, the receptacle is configured to receive a single contact lens and an amount of packaging solution sufficient to completely cover the contact lens, typically about 0.5-1.5 ml. In one example, the receptacle comprises a plastic base member comprising a cavity configured to retain the contact lens and packaging solution and a flange region extending outwardly around the cavity, and the cover comprises a removable foil (or other sealing cover or lid) attached to the flange region to provide the sealed contact lens package. The removable foil (or other sealing cover or lid) may be sealed by any conventional means such as heat sealing or gluing. The method of manufacturing the sealed contact lens package may further comprise sterilizing the unworn contact lens by autoclaving the sealed contact lens package. The sealed package may be sterilized by sterilizing amounts of radiation, including heat or steam, such as by autoclaving, or by gamma radiation, e-beam radiation, ultraviolet radiation, etc. Autoclaving generally involves subjecting the sealed contact lens package to temperatures of at least 121° C. for at least 20 minutes.

With the present invention, it becomes possible to recycle used or opened contact lens packages as a collective unit such that the packages that form the collective unit preferably do not break or separate while being processed at a recycling facility (and the collective unit is sufficiently dimensioned so as to be processes as recyclable material).

With the present invention, a person has an easy way to recycle used or opened contact lens packages.

With the present invention, a person has a simply yet efficient way to recycle used or opened contact lens packages, and by providing a simple way, this can encourage a person to actually recycle this material.

References herein to "an example" or "a specific example" or "an aspect" or "an embodiment" or similar phrase, are intended to introduce a feature or features of the invention, or components thereof, or methods thereof (depending on context) that can be combined with any combination of previously-described or subsequently-described examples, aspects, embodiments (i.e. features), unless a particular combination of features is mutually exclusive, or if context indicates otherwise. Further, as used in this specification, the singular forms "a," "an," and "the" include plural referents (e.g. at least one or more) unless the context clearly dictates otherwise. Thus, for example, reference to a "contact lens" includes a single lens as well as two or more of the same or different lenses.

The present invention includes the following aspects/embodiments/features in any order and/or in any combination:

1. The present invention relates a contact lens package kit comprising:

a plurality of contact lens packages, wherein each contact lens package comprises a base member having a cavity and a sealing member coupled to the base member to provide a sealed cavity, and an unworn contact lens is provided in a contact lens packaging solution within the sealed cavity; and wherein the base member is a thermoplastic material and includes a substantially planar surface surrounding the cavity, said substantially planar surface providing a sealing surface for the sealing member, and at least one fastener configured to retain a plurality of base members from each of said contact lens packages after said contact lens is removed from the cavity.

2. The contact lens package kit or method or other embodiment of any preceding or following embodiment/feature/aspect, wherein the plurality of contact lens packages is arranged in an array and have perforations in the sealing member at a location corresponding to adjacent base members.

3. The contact lens package kit or method or other embodiment of any preceding or following embodiment/feature/aspect, wherein each of said base members includes an opening spaced apart from the cavity dimensioned to receive said fastener and attach said base member to said fastener.

4. The contact lens package kit or method or other embodiment of any preceding or following embodiment/feature/aspect, wherein the fastener has a length, and said fastener has a plurality of openings located along at least a portion of said length, wherein each of said openings is shaped so as to receive at least a portion of said base member thereby attaching said base member to said fastener.

5. The contact lens package kit or method or other embodiment of any preceding or following embodiment/feature/aspect, wherein said fastener is an elongated flat profiled strip.

6. The contact lens package kit or method or other embodiment of any preceding or following embodiment/feature/aspect, wherein said fastener has a length, and said fastener has a plurality of openings located along at least a portion of said length.

7. The contact lens package kit or method or other embodiment of any preceding or following embodiment/feature/aspect, wherein said fastener is made from at least one thermoplastic.

8. The contact lens package kit or method or other embodiment of any preceding or following embodiment/feature/aspect, wherein said fastener is made from at least one thermoplastic, wherein said thermoplastic is the same type as said thermoplastic material of said base member.

9. The contact lens package kit or method or other embodiment of any preceding or following embodiment/feature/aspect, wherein said fastener has a weight of less than 2 grams.

10. The contact lens package kit or method or other embodiment of any preceding or following embodiment/feature/aspect, wherein said fastener has a weight of from 0.2 gram to 1.95 grams.

11. The contact lens package kit or method or other embodiment of any preceding or following embodiment/feature/aspect, wherein said fastener has a weight of from 0.2 gram to 1.3 grams.

12. The contact lens package kit or method or other embodiment of any preceding or following embodiment/feature/aspect, wherein said fastener has a length such that at least 10 of said base members are attachable to said fastener.

13. The contact lens package kit or method or other embodiment of any preceding or following embodiment/feature/aspect, wherein said fastener has a total weight that is less than 10% of the weight of the plurality of said base members retained by the fastener.

14. The contact lens package kit or method or other embodiment of any preceding or following embodiment/feature/aspect, wherein said fastener has a weight that is no greater than the total weight of the material needed to occupy the opening of each of the plurality of said base members.

15. The contact lens package kit or method or other embodiment of any preceding or following embodiment/feature/aspect, wherein said base members are attachable to said fastener such that the plurality of base members is oriented on the fastener in either in a single stacked configuration or an alternating multiple stacked configuration.

16. The contact lens package kit or method or other embodiment of any preceding or following embodiment/feature/aspect, wherein said fastener has a length, a width, a top end, a bottom end, and side edges, and wherein said side edges include indentations or notches along a majority of said length, wherein said indentations or notches are shaped to interlock with said opening in each of said base members.

17. The contact lens package kit or method or other embodiment of any preceding or following embodiment/feature/aspect, wherein said fastener has a bottom end that is shaped such that said opening of said base member cannot pass through.

18. An embodiment that is a recyclable contact lens assembly comprising a plurality of empty contact lens packages, wherein each empty contact lens package comprises a base member having a cavity and wherein the base member is a thermoplastic material and has a substantially planar surface surrounding the cavity, and at least one fastener, wherein said plurality of base members are attached to said fastener.

19. The recyclable contact lens assembly, or contact lens package kit or method or other embodiment of any preceding or following embodiment/feature/aspect, wherein said recyclable contact lens assembly has at least an overall height of at least 2 inches and either or both of a width and depth of at least 2 inches.

20. The recyclable contact lens assembly, or contact lens package kit or method or other embodiment of any preceding or following embodiment/feature/aspect, wherein said recyclable contact lens assembly has at least an overall height of at least 4 inches and either or both of a width and depth of at least 2 inches.

21. An embodiment that is a method to recycle used contact lens packages, said method comprising attaching a plurality of empty contact lens packages to a fastener, wherein each empty contact lens package comprises a base member having a cavity and wherein the base member is a thermoplastic material and has a substantially planar surface surrounding the cavity.

22. An embodiment that is a fastener for attaching a plurality of empty contact lens packages to said fastener, said fastener is a thermoplastic material configured to retain a plurality of base members from each of said empty contact lens packages after said contact lens is removed from the cavity wherein each empty contact lens package comprises a base member having a cavity and wherein the base member is a thermoplastic material and has a substantially planar surface surrounding the cavity.

23. The fastener or recyclable contact lens assembly, or contact lens package kit or method or other embodiment of any preceding or following embodiment/feature/aspect, wherein said fastener has a length, and said fastener has a plurality of openings located along at least a portion of said length, wherein each of said openings is shaped so as to receive at least a portion of said base member thereby attaching said base member to said fastener.

24. The fastener or recyclable contact lens assembly, or contact lens package kit or method or other embodiment of any preceding or following embodiment/feature/aspect, wherein said fastener is an elongated flat profiled strip.

25. The fastener or recyclable contact lens assembly, or contact lens package kit or method or other embodiment of any preceding or following embodiment/feature/aspect, wherein said fastener has a length, and said fastener has a plurality of openings located along at least a portion of said length.

26. The fastener or recyclable contact lens assembly, or contact lens package kit or method or other embodiment of any preceding or following embodiment/feature/aspect, wherein said thermoplastic material is the same type as said thermoplastic material of said base member.

27. The fastener or recyclable contact lens assembly, or contact lens package kit or method or other embodiment of any preceding or following embodiment/feature/aspect, wherein said fastener has a weight of less than 2 grams.

28. The fastener or recyclable contact lens assembly, or contact lens package kit or method or other embodiment of any preceding or following embodiment/feature/aspect, wherein said fastener has a weight of from 0.2 gram to 1.95 grams.

29. The fastener or recyclable contact lens assembly, or contact lens package kit or method or other embodiment of any preceding or following embodiment/feature/aspect, wherein said fastener has a weight of from 0.2 gram to 1.3 grams.

30. The fastener or recyclable contact lens assembly, or contact lens package kit or method or other embodiment of any preceding or following embodiment/feature/aspect, wherein said fastener has a length such that at least 10 of said base members are attachable to said fastener.

31. The fastener or recyclable contact lens assembly, or contact lens package kit or method or other embodiment of any preceding or following embodiment/feature/aspect, wherein said fastener has a total weight that is less than 10% of the weight of the plurality of said base members retained by the fastener.

32. The fastener or recyclable contact lens assembly, or contact lens package kit or method or other embodiment of any preceding or following embodiment/feature/aspect, wherein each of said base members includes an opening spaced apart from the cavity dimensioned to receive said fastener and attach said base member to said fastener and wherein said fastener has a weight that is no greater than the total weight of the material needed to occupy the opening of each of the plurality of said base members.

33. The fastener or recyclable contact lens assembly, or contact lens package kit or method or other embodiment of any preceding or following embodiment/feature/aspect, wherein each of said base members includes an opening spaced apart from the cavity dimensioned to receive said fastener and attach said base member to said fastener and wherein said fastener has a length, a width, a top end, a bottom end, and side edges, and wherein said side edges include indentations or notches along a majority of said length, wherein said indentations or notches are shaped to interlock with said opening in each of said base members.

34. The fastener or recyclable contact lens assembly, or contact lens package kit or method or other embodiment of any preceding or following embodiment/feature/aspect, wherein said fastener has a bottom end that is shaped such that said opening of said base member cannot pass through.

The present invention can include any combination of these various features or embodiments above and/or below as set forth in sentences and/or paragraphs. Any combination of disclosed features herein is considered part of the present invention and no limitation is intended with respect to combinable features.

The disclosure herein refers to certain illustrated examples, it is to be understood that these examples are presented by way of example and not by way of limitation. The intent of the foregoing detailed description, although discussing exemplary examples, is to be construed to cover all modifications, alternatives, and equivalents of the examples as may fall within the spirit and scope of the invention as defined by the additional disclosure.

The entire contents of all cited references in this disclosure, to the extent that they are not inconsistent with the present disclosure, are incorporated herein by reference.

The present invention can include any combination of the various features or embodiments described above and/or in the claims below as set forth in sentences and/or paragraphs. Any combination of disclosed features herein is considered part of the present invention and no limitation is intended with respect to combinable features.

Other embodiments of the present invention will be apparent to those skilled in the art from consideration of the present specification and practice of the present invention disclosed herein. It is intended that the present specification and examples be considered as exemplary only with a true scope and spirit of the invention being indicated by the following claims and equivalents thereof.

What is claimed is:

1. A contact lens package kit comprising:

a plurality of contact lens packages, wherein each contact lens package comprises a base member having a cavity and a sealing member coupled to the base member to provide a sealed cavity, and an unworn contact lens is provided in a contact lens packaging solution within the sealed cavity; and wherein the base member is a thermoplastic material and includes a substantially planar surface surrounding the cavity, said substantially planar surface providing a sealing surface for the sealing member, and at least one fastener configured to retain a plurality of base members from each of said contact lens packages after said contact lens is removed from the cavity wherein each of said base members includes an opening spaced apart from the cavity dimensioned to receive said fastener and attach said base member to said fastener.

2. The contact lens package kit of claim 1, wherein the plurality of contact lens packages is arranged in an array and have perforations in the sealing member at a location corresponding to adjacent base members.

3. The contact lens package kit of claim 1, wherein said fastener has a length, and said fastener has a plurality of openings located along at least a portion of said length, wherein each of said openings is shaped so as to receive at least a portion of said base member thereby attaching said base member to said fastener.

4. The contact lens package kit of claim 1, wherein said fastener is an elongated flat profiled strip.

5. The contact lens package kit of claim 1, wherein said fastener has a length, and said fastener has a plurality of openings located along at least a portion of said length.

6. The contact lens package kit of claim 1, wherein said fastener is made from at least one thermoplastic.

7. The contact lens package kit of claim 1, wherein said fastener is made from at least one thermoplastic, wherein said thermoplastic is the same type as said thermoplastic material of said base member.

8. The contact lens package kit of claim 1, wherein said fastener has a weight of less than 2 grams.

9. The contact lens package kit of claim 1, wherein said fastener has a weight of from 0.2 gram to 1.95 grams.

10. The contact lens package kit of claim 1, wherein said fastener has a weight of from 0.2 gram to 1.3 grams.

11. The contact lens package kit of claim 1, wherein said fastener has a length such that at least 10 of said base members are attachable to said fastener.

12. The contact lens package kit of claim 1, wherein said fastener has a total weight that is less than 10% of the weight of the plurality of said base members retained by the fastener.

13. The contact lens package kit of claim 1, wherein said fastener is made of plastic and has a weight that is no greater than the total weight of the plastic material needed to occupy the opening of each of the plurality of said base members.

14. The contact lens package kit of claim 1, wherein said base members are attachable to said fastener such that the plurality of base members is oriented on the fastener in either in a single stacked configuration or an alternating multiple stacked configuration.

15. The contact lens package kit of claim 1, wherein said fastener has a length, a width, a top end, a bottom end, and side edges, and wherein said side edges include indentations or notches along a majority of said length, wherein said indentations or notches are shaped to interlock with said opening in each of said base members.

16. The contact lens package kit of claim 1, wherein said fastener has a bottom end that is shaped such that said opening of said base member cannot pass through said bottom end.

17. Recyclable contact lens assembly comprising a plurality of empty contact lens packages, wherein each empty contact lens package comprises a base member having a cavity and wherein the base member is a thermoplastic material and has a substantially planar surface surrounding the cavity, and at least one fastener, wherein said plurality of base members are attached to said fastener and wherein each of said base members includes an opening spaced apart from the cavity dimensioned to receive said fastener and attach said base member to said fastener.

18. The recyclable contact lens assembly of claim 17, wherein said recyclable contact lens assembly has at least an overall height of at least 2 inches and either or both of a width and depth of at least 2 inches.

19. The recyclable contact lens assembly of claim 17, wherein said recyclable contact lens assembly has at least an overall height of at least 4 inches and either or both of a width and depth of at least 2 inches.

* * * * *